US007598919B2

(12) United States Patent
Rao et al.

(10) Patent No.: US 7,598,919 B2
(45) Date of Patent: Oct. 6, 2009

(54) PICK-UP HORN FOR HIGH POWER THERMAL VACUUM TESTING OF SPACECRAFT PAYLOADS

(75) Inventors: Sudhakar K. Rao, Churchville, PA (US); Clency Lee-Yow, Longmont, CO (US); Philip Venezia, Longmont, CO (US); Rodolfo Lozano, Jr., San Diego, CA (US); David V. Gardner, Newtown, PA (US); Joseph T. Durcanin, Newtown, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 142 days.

(21) Appl. No.: 11/446,974

(22) Filed: Jun. 6, 2006

(65) Prior Publication Data

US 2007/0159406 A1 Jul. 12, 2007

Related U.S. Application Data

(60) Provisional application No. 60/758,940, filed on Jan. 12, 2006.

(51) Int. Cl.
*H01Q 13/02* (2006.01)

(52) U.S. Cl. ..... 343/786; 343/703

(58) Field of Classification Search ..... 343/786, 343/703, 772

See application file for complete search history.

(56) References Cited

U.S. PATENT DOCUMENTS 3,553,707 A * 1/1971 Yang et al. ..... 343/781 R
3,908,189 A 9/1975 Buehler et al.
4,164,718 A 8/1979 Iwasaki
4,319,248 A 3/1982 Flam
4,554,552 A * 11/1985 Alford et al. ..... 343/786
4,645,358 A 2/1987 Blume
5,039,949 A 8/1991 Hemming et al.

(Continued)

FOREIGN PATENT DOCUMENTS

EP 1 006 049 A2 6/2000

(Continued)

OTHER PUBLICATIONS

International Search Report & Written Opinion, Appl. No. PCT/US06/47594. Jun. 24, 2008.*

*Primary Examiner*—Michael C Wimer
(74) *Attorney, Agent, or Firm*—McDermott Will & Emery LLP

(57) ABSTRACT

A pick-up horn for absorbing radiation emitted by a transmit antenna is provided. The pick-up horn includes at least one outer metal wall forming a metal body and at least one interior surface disposed in the metal body, forming at least one chamber in the metal body. The pick-up horn further includes a front metal surface disposed at a front end of the metal body, having at least one opening corresponding to the at least one chamber, and at least one high-power absorbing load disposed within the at least one chamber and in contact with the at least one interior surface. The pick-up horn may further include a serpentine coolant path disposed within the metal body between an outer surface of the at least one outer metal wall and the at least one high-power absorbing load.

19 Claims, 7 Drawing Sheets

U.S. PATENT DOCUMENTS

| | | | | |
|---|---|---|---|---|
| 5,113,190 | A | 5/1992 | Klein | |
| 5,188,862 | A | 2/1993 | Itatani et al. | |
| 5,631,661 | A | 5/1997 | Sanchez | |
| 5,847,681 | A | 12/1998 | Faherty et al. | |
| 5,963,176 | A | 10/1999 | Solheim et al. | |
| 6,075,495 | A | 6/2000 | Podgorski | |
| 6,295,032 | B1 | 9/2001 | Podgorski | |
| 6,567,046 | B2 | 5/2003 | Taylor et al. | |
| 6,611,238 | B1 * | 8/2003 | Santoru et al. | 343/840 |
| 2002/0044094 | A1 | 4/2002 | May | |
| 2002/0080081 | A1 | 6/2002 | Liu | |
| 2003/0080914 | A1 | 5/2003 | Eom et al. | |
| 2004/0113853 | A1 | 6/2004 | Serban et al. | |
| 2005/0030241 | A1 | 2/2005 | Brown et al. | |
| 2005/0099345 | A1 | 5/2005 | Von Klilzing et al. | |
| 2005/0110695 | A1 | 5/2005 | Jung et al. | |
| 2005/0212712 | A1 | 9/2005 | Pryor et al. | |
| 2005/0259025 | A1 | 11/2005 | Cook | |
| 2006/0262021 | A1 | 11/2006 | Matsui | |
| 2007/0188396 | A1 | 8/2007 | Greissbaum et al. | |

FOREIGN PATENT DOCUMENTS

| | | |
|---|---|---|
| WO | WO 2005/050255 A2 | 6/2005 |

* cited by examiner

PICK-UP HORN FOR HIGH POWER THERMAL VACUUM TESTING OF SPACECRAFT PAYLOADS

CROSS-REFERENCE TO RELATED APPLICATION

The present application claims the benefit of priority under 35 U.S.C. §119 from U.S. Provisional Patent Application Ser. No. 60/758,940 entitled "PICK-UP HORN METHOD FOR HIGH-POWER TVAC TEST OF SPACECRAFT PAYLOADS," filed on Jan. 12, 2006, the disclosure of which is hereby incorporated by reference in its entirety for all purposes.

STATEMENT REGARDING FEDERALLY SPONSORED RESEARCH OR DEVELOPMENT

Not Applicable.

FIELD OF THE INVENTION

The present invention generally relates to the testing of spacecraft and, more particularly, relates to the high-power thermal vacuum testing of spacecraft payloads.

BACKGROUND OF THE INVENTION

Prior to launch, spacecraft are regularly subjected to thermal vacuum testing to ensure that their payloads function as intended in the vacuum of space. Because the payloads of spacecraft frequently operate at very high power (e.g., radiating antennas operating at 2000 W or more), testing payload operations at full power in a vacuum environment presents a number of challenges. The power radiated from the antennas of the spacecraft must be fully absorbed, without any potentially damaging leakage of power reaching the receive antennas or any other flight hardware.

One approach to absorbing the power radiated by a spacecraft in a thermal vacuum ("TVAC") chamber uses large, expensive absorber boxes that surround the power generating antennas. Because these absorber boxes are so large, they frequently prevent all antennas on a spacecraft from being tested at the same time. Accordingly, the TVAC chamber must be de-pressurized, the absorber boxes moved to different antennas on the spacecraft and the TVAC chamber re-pressurized before testing can continue. This approach is very slow, as the process of de-pressurizing and re-pressurizing the TVAC chamber and testing the spacecraft can take up to two or three months.

Another approach uses waveguides to redirect the power generated by the radiating antennas of a spacecraft outside of the TVAC chamber through radio frequency-transparent ceramic windows. To attach the waveguides, it is necessary to decouple the radiating antennas from the spacecraft, which can negatively affect the accuracy of the payload testing. Because waveguides are sensitive to the polarization of radiation, working best with linearly polarized radiation, there may be significant return loss (i.e., reflection of incident radiation) with antennas that emit elliptically polarized radiation. Moreover, the ceramic window through which the waveguide directs the radiation presents a danger of vacuum compromise, which can result in damage to the spacecraft.

Accordingly, there is a need for a way to perform high-power thermal vacuum testing of spacecraft payloads that is less expensive, less time-consuming and insensitive to polarization, that does not require decoupling antennas from the spacecraft, and that can accommodate all of the antennas on the spacecraft in one test set-up. The present invention satisfies these needs and provides other advantages as well.

SUMMARY OF THE INVENTION

In accordance with the present invention, a pick-up horn is provided for use during high-power thermal vacuum testing of a spacecraft payload. A pick-up horn is disposed in front of and physically separate from each radiating antenna on a spacecraft. Each pick-up horn includes an outer metal wall forming a metal body having one or more chambers, and a front metal face having one or more openings corresponding to the one or more chambers. In each chamber, one or more high-power absorbing loads are disposed. Each pick-up horn further includes a coolant path disposed within the metal body, through which coolant flows, for transferring the heat generated by the high-power absorbing loads to the coolant.

According to one embodiment, the present invention is a pick-up horn for absorbing radiation emitted by an antenna. The pick-up horn includes at least one outer metal wall forming a metal body and at least one interior surface disposed in the metal body, forming at least one chamber in the metal body. The pick-up horn further includes a front metal surface disposed at a front end of the metal body, having at least one opening corresponding to the at least one chamber, and at least one high-power absorbing load disposed within the at least one chamber and in contact with the at least one interior surface.

According to another embodiment, the present invention is a pick-up horn for absorbing radiation emitted by an antenna. The pick-up horn includes at least one outer metal wall forming a metal body and a plurality of interior surfaces disposed in the metal body and forming a plurality of chambers in the metal body. The pick-up horn further includes a front metal surface disposed at a front end of the metal body, having a plurality of openings corresponding to the plurality of chambers, and a plurality of ceramic high-power absorbing loads. Each high-power absorbing load is disposed within a corresponding one of the plurality of chambers and in contact with at least one of the plurality of interior surfaces. The pick-up horn further includes a serpentine coolant path disposed within the metal body between an outer surface of the at least one outer metal wall and the plurality of ceramic high-power absorbing loads. The coolant path includes a coolant inlet and a coolant outlet, each of which is disposed on the outer surface of the at least one outer metal wall.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown-in detail to avoid unnecessarily obscuring the present invention.

The present invention provides a pick-up horn for use during high-power thermal vacuum testing of a spacecraft payload. A pick-up horn is disposed in front of (e.g., disposed in front of and physically separate from) each radiating antenna on a spacecraft. Each pick-up horn absorbs the radiation (e.g., from 10 GHz to 18 GHz) emitted by its corresponding radiating antenna with high-power absorbing loads and converts the absorbed radiation to heat energy, which is removed from the pick-up horn by a cooling system.

Figure 1A:
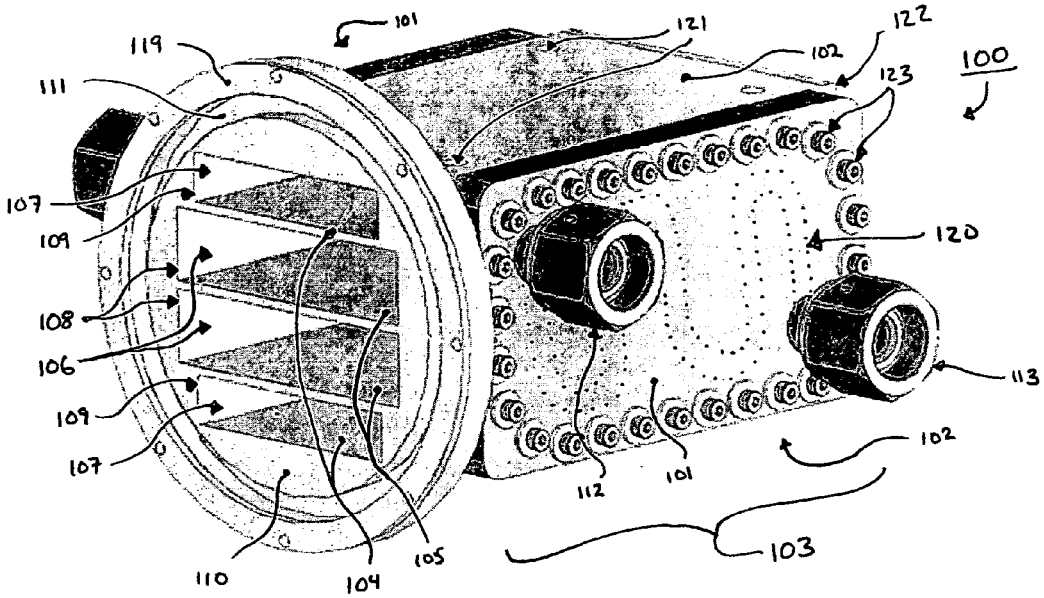
FIGS. 1A to 1C depict various views of a pick-up horn according to one embodiment of the present invention.
Figure 1C:
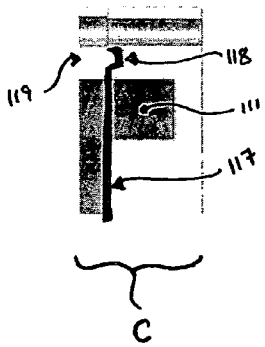
Figure 1B:
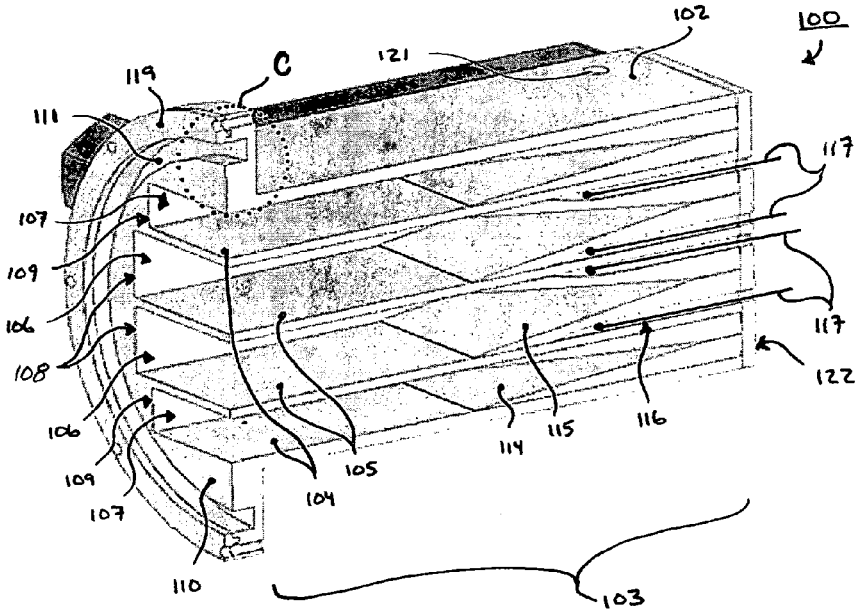

FIGS. 1A to 1C illustrate a pick-up horn 100 according to one embodiment of the present invention. Pick-up horn 100 includes outer metal walls, such as side walls 101, top and bottom walls 102 and RF shorting back plate 122, which form a metal body 103. Pick-up horn 100 further includes interior surfaces 104 and 105, which form inner chambers 106 and outer chambers 107 in metal body 103. At a front end of metal body 103 is disposed a front metal surface 110 with rectangular openings 108 and 109 corresponding to chambers 106 and 107. Within each chamber 106 and 107 is disposed one or more wedge-shaped high-power absorbing loads 114 and 115, each of which is in contact with one of the interior surfaces (e.g., 104 and 105, respectively). Grooves 116 are provided between the high-power absorbing loads and the interior surfaces, to receive thermocouples 117 for monitoring the temperature of pick-up horn 100. Vent holes 121 provide an outgassing path between outer metal wall 102 and the chambers for the escape of gas released by the high-power absorbing loads 114 and 115 or by any other component.

According to one embodiment, outer metal walls 101, 102 and 122 are assembled to provide a vacuum seal using stainless steel cover screws 123 and a knife edge and Sn96 solder. While in the present exemplary embodiment, metal body 103 is shown as a box shape being formed by five outer metal walls, the scope of the present invention is not limited to such an arrangement. Rather, the present invention may include any number of outer metal walls, including one (e.g., a conical wall), which form a metal body of any shape.

According to one embodiment, high-power absorbing loads 114 and 115 are space-qualified ceramic high-power absorbing loads with power absorption of about 30 dB/inch such as, for example, RS-4200 CHP. Each high-power absorbing load 114 and 115 is bonded to corresponding interior surface 104 and 105 with a thin (e.g., 0.005" thick) layer of thermally conductive bonding epoxy such as, for example, CV2646. The bonding epoxy is applied with high pressure to improve the thermal conduction between the high-power absorbing loads 114 and 115 and the interior surfaces 104 and 105. According to one embodiment, high-power absorbing loads 114 and 115 are further secured to interior surfaces 104 and 105 with fasteners, such as, for example, screws, to insure against failure of the bonding epoxy.

While the present exemplary embodiment has been described as including RS-4200 CHP ceramic high-power absorbing loads, the scope of the present invention is not limited to such an arrangement. As will be apparent to one of skill in the art, any one of a number of high-power absorbing loads may be used. In an embodiment of the present invention intended for TVAC testing, the high-power absorbing loads used should have low outgassing properties.

While the present exemplary embodiment has been described as including thermally conductive bonding epoxy CV2646, the scope of the present invention is not limited to such an arrangement. As will be apparent to one of skill in the art, any one of a number of thermally conductive bonding epoxies may be used within the scope of the present invention. For example, any of a number of silver-filled silicone adhesives known to those of skill in the art may be used. In an embodiment of the present invention intended for TVAC testing, the thermally conductive bonding epoxy used should have low outgassing properties.

The heat generated by high-power absorbing loads 114 and 115 as they absorb radiation is removed from pick-up horn 100 by a cooling system. Coolant flows through metal body 103, entering at coolant inlet 112 on outer metal wall 101, passing through serpentine coolant path 120 between outer metal wall 101 and chambers 106 and 107, and exiting through coolant outlet 113 on outer metal wall 101. Vacuum chambers are routinely provided with liquid or gaseous nitrogen cooling systems, to which pick-up horn 100 may be connected. As will be apparent to one of skill in the art, however, pick-up horn 100 may employ any one of a number of coolants for removing heat from high-power absorbing loads 114 and 115.

Thermocouples 117 allow for temperature monitoring of pick-up horn 100, particularly along the thermal interface between the high-power absorbing loads and their respective interior surfaces. According to one embodiment, thermocouples 117 are coupled to a monitoring system which sounds an audible alarm and/or discontinues the high-power testing should any of thermocouples 117 indicate a temperature higher than a predetermined temperature limit.

When pick-up horn 100 is disposed in front of a radiating antenna, the radiation emitted thereby enters chambers 106 and 107 through respective openings 108 and 109. The openings are "oversized" in that they are insensitive to the polarization of radiation emitted by the radiating antenna. Moreover, the size of the openings allows pick-up horn 100 to absorb not only the radiation emitted by the radiating antenna in the dominant mode, but in higher-order modes as well. Finally, the size of the openings allows pick-up horn 100 to be substantially RF-transparent (e.g., about 99% transparent) to the radiating antenna.

The central region of a wavefront emitted by a radiating antenna typically has a higher amplitude than the outer regions. Accordingly, the openings nearer the center of front metal surface 110, such as opening 108, are larger than those farther away, such as opening 109, so that these central openings can accommodate the larger amount of energy radiated in this region of the wavefront. According to one embodiment, a pick-up horn of the present invention includes odd number of chambers and openings, such that the area of the central opening includes the geometric center of the radiated wavefront. In this manner, the surface area of the front metal surface is minimized in this region of high amplitude radiation, to reduce undesirable return loss (e.g., the reflection of radiation back to the radiating antenna).

According to one embodiment, the metal used for outer metal walls 101 and 102 is stainless steel. Alternatively, any one of a number of other metals, such as copper, aluminum, and the like may be used. According to one embodiment, front metal surface 1 10 is composed of a different metal than outer metal walls 101 and 102. For example, front metal surface 110 may be made of copper (Cu), while outer metal walls 101 and 102 are made of stainless steel. While the present exemplary embodiments have been described with reference to particular metals, it will be apparent to one of skill in the art that the present invention has application to a wide range of metals, and is not limited to the use of those listed herein.

A radio frequency ("RF") choke 111, in the form of an annular groove, is located around an outer region of front metal surface 110. The RF choke minimizes RF leakage from pick-up horn 100. In one exemplary experimental embodiment, discussed more fully below with reference to FIG. 7, the RF choke allowed less than 0.01% of the total input power applied to a pick-up horn of the present invention to leak into the test chamber.

As can be seen with reference to FIG. 1C, which provides a more detailed view of region C in FIG. 1B, an RF-transparent debris shield 117 is located over front metal surface 110, and is held in place by a clamp ring 119 disposed into clamp groove 118. Debris shield 117 covers front metal surface 110 and openings 108 and 109 to protect the sensitive and expensive antenna in front of which pick-up horn 100 is disposed from being damaged in the event that any debris is knocked loose from pick-up horn 100 during testing. According to one embodiment, debris shield 117 is a polyimide film such as Kapton®. Alternatively, debris shield 117 may be any material which is substantially RF-transparent and capable of withstanding high power radiation.

The dimensions of pick-up horn 100 are significantly smaller than the dimensions of an absorber box designed for use with a similar transmit antenna. According to one embodiment applicable for use with a Ku-band transmit antenna, pick-up horn 100 is about 5" tall by 5" wide by 6" long. The scope of the present invention is not limited to pick-up horns with the dimensions of this exemplary embodiment, of course, but rather covers pick-up horns of any size.

Figure 2:
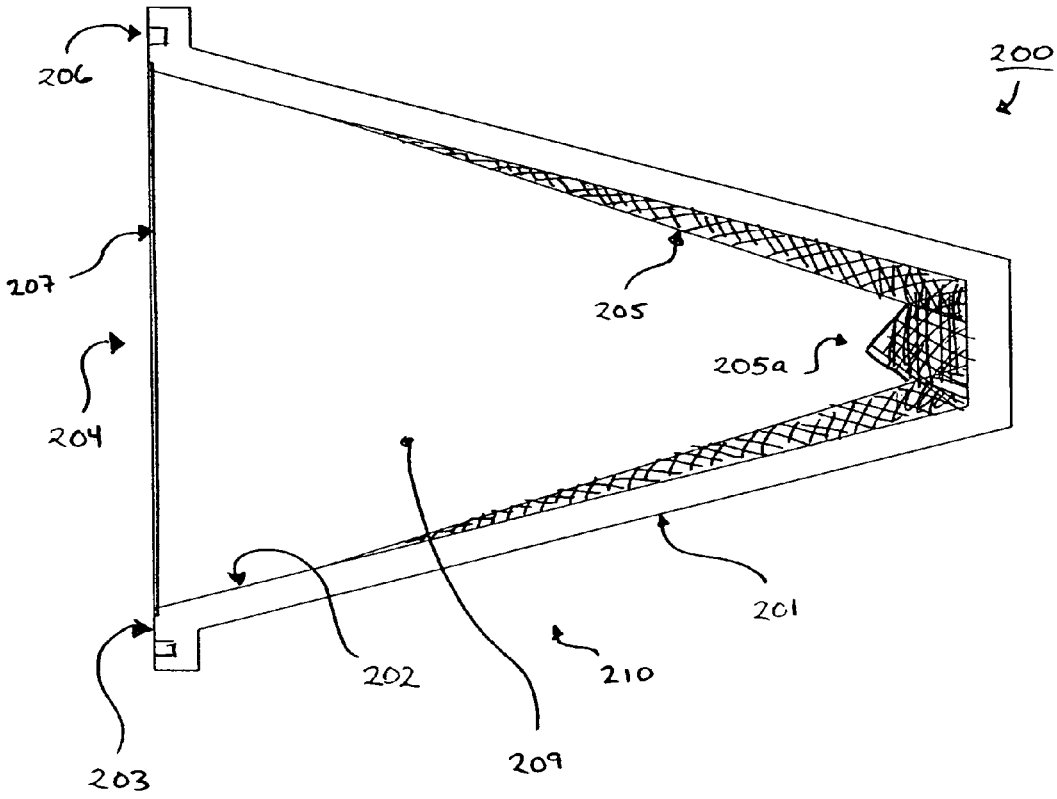
FIG. 2 depicts a partial cut-away view of a pick-up horn according to another embodiment of the present invention.

Turning to FIG. 2, a pick-up horn 200 according to another embodiment of the present invention is illustrated in a partial cut-away view. Pick-up horn 200 includes an outer metal wall 201 forming a conical metal body 210. An interior surface 202 within metal body 210 forms a single chamber 209, which has a corresponding circular (e.g., elliptical) opening 204 in a front metal surface 203 of metal body 210. An RF-transparent debris shield 207 is disposed over front metal surface 203. Surrounding opening 204, an RF choke 206 is formed in the shape of an annular groove in front metal surface 203. Within chamber 209 is disposed a high-power absorbing load 205 with a substantially conical shape. High-power absorbing load 205 includes a raised conical central region 205*a* which projects back towards opening 204.

Figure 3A:
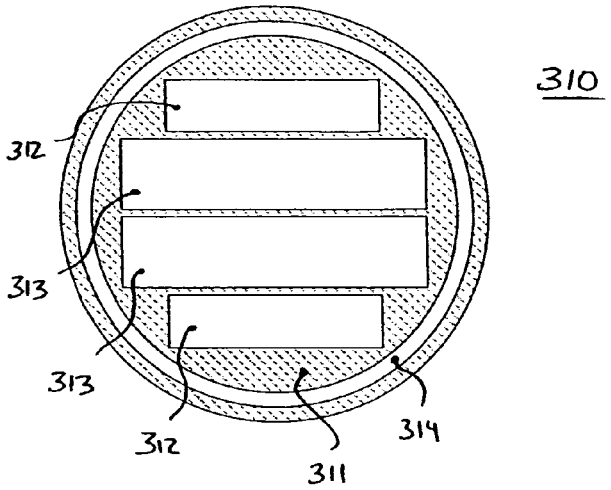
FIGS. 3A to 3C depict frontal views of pick-up horns according to various embodiments of the present invention.
Figure 3B:
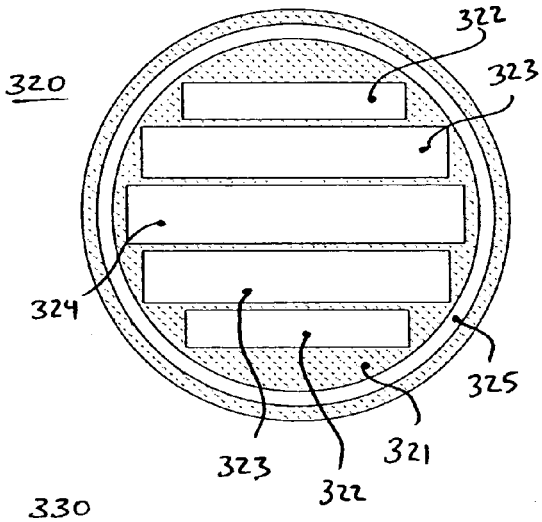
Figure 3C:
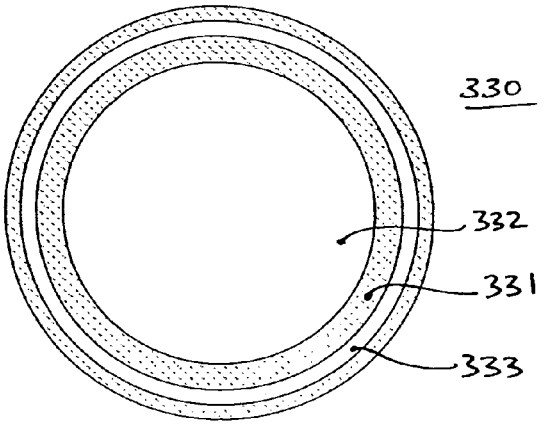

Turning to FIGS. 3A-3C, frontal views of a number of pick-up horns are illustrated, according to various embodiments of the present invention. In FIG. 3A, pick-up horn 310 includes a front metal surface 311, in which rectangular openings 312 and 313 are disposed. Openings 313, being closer to a center of front metal surface 311, are larger in width and breadth than openings 312, which are farther from the center. An RF choke 314 in the form of an annular groove is disposed around an outer region of front metal surface 311.

Pick-up horn 320, illustrated in FIG. 3B, includes a front metal surface 321 with an odd number of rectangular openings 322, 323 and 324. Opening 324, which is located in the center of front metal surface 321, is positioned to absorb the geometric center of a radiated wavefront. Accordingly, opening 324 is larger than more radially distant openings 323 and 322, in order to accommodate the higher amplitude radiation in this region of the wavefront. An RF choke 325 in the form of an annular groove is disposed around an outer region of front metal surface 321.

Pick-up horn 330, illustrated in FIG. 3C, includes a front metal surface 331 with a single elliptical (e.g., circular) opening 332. In this arrangement, the area of front metal surface 331 is minimized, to reduce the return loss (e.g., reflection of part of a radiated signal) of pick-up horn 330. An RF choke 333 in the form of an annular groove is disposed around an outer region of front metal surface 331.

While the present exemplary embodiments have illustrated pick-up horns with particular arrangements of rectangular or elliptical openings, the scope of the present invention is not limited to these arrangements. Rather, as will be apparent to one of skill in the art, a pick-up horn with any number of openings of any shape and size may be used to absorb radiation emitted by a transmit antenna within the scope of the present invention.

Figure 4:
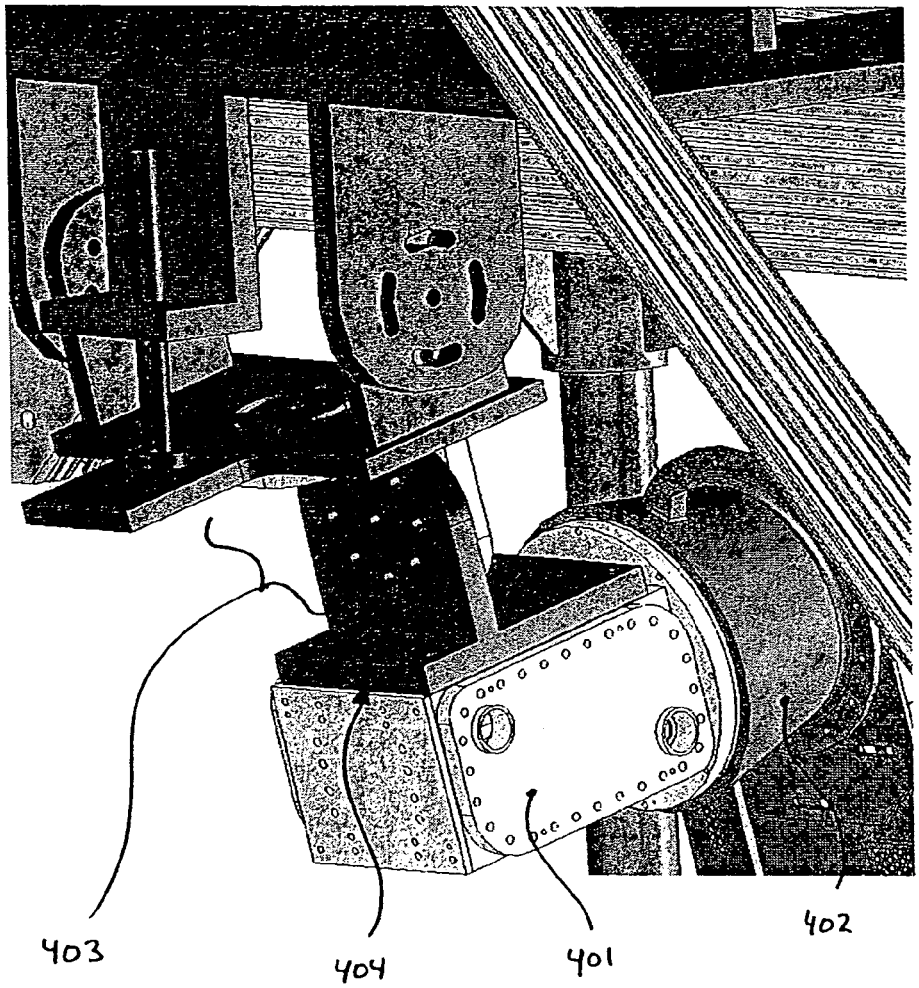
FIG. 4 depicts a pick-up horn disposed in front of a transmit antenna according to one embodiment of the present invention.

Turning to FIG. 4, the arrangement of a pick-up horn 401 for testing a transmit antenna 402 is illustrated according to one embodiment of the present invention. Pick-up horn 401 is connected to pivot mechanism 403 with non-conductive bracket 404. Pivot mechanism 403 provides 360° of freedom in order to facilitate the alignment of pick-up horn 401 with transmit antenna 402 which is disposed on a satellite (not illustrated). Pick-up horn 401 is disposed in front of (e.g., about 0.2" from) transmit antenna 402. No contact between pick-up horn 401 and transmit antenna 402 is needed for pick-up horn 401 to absorb the radiation emitted by transmit antenna 402. Accordingly, transmit antenna 402 is protected from any damage that could be caused by physically mating transmit antenna 402 with other radiation absorbing systems.

Figure 5:
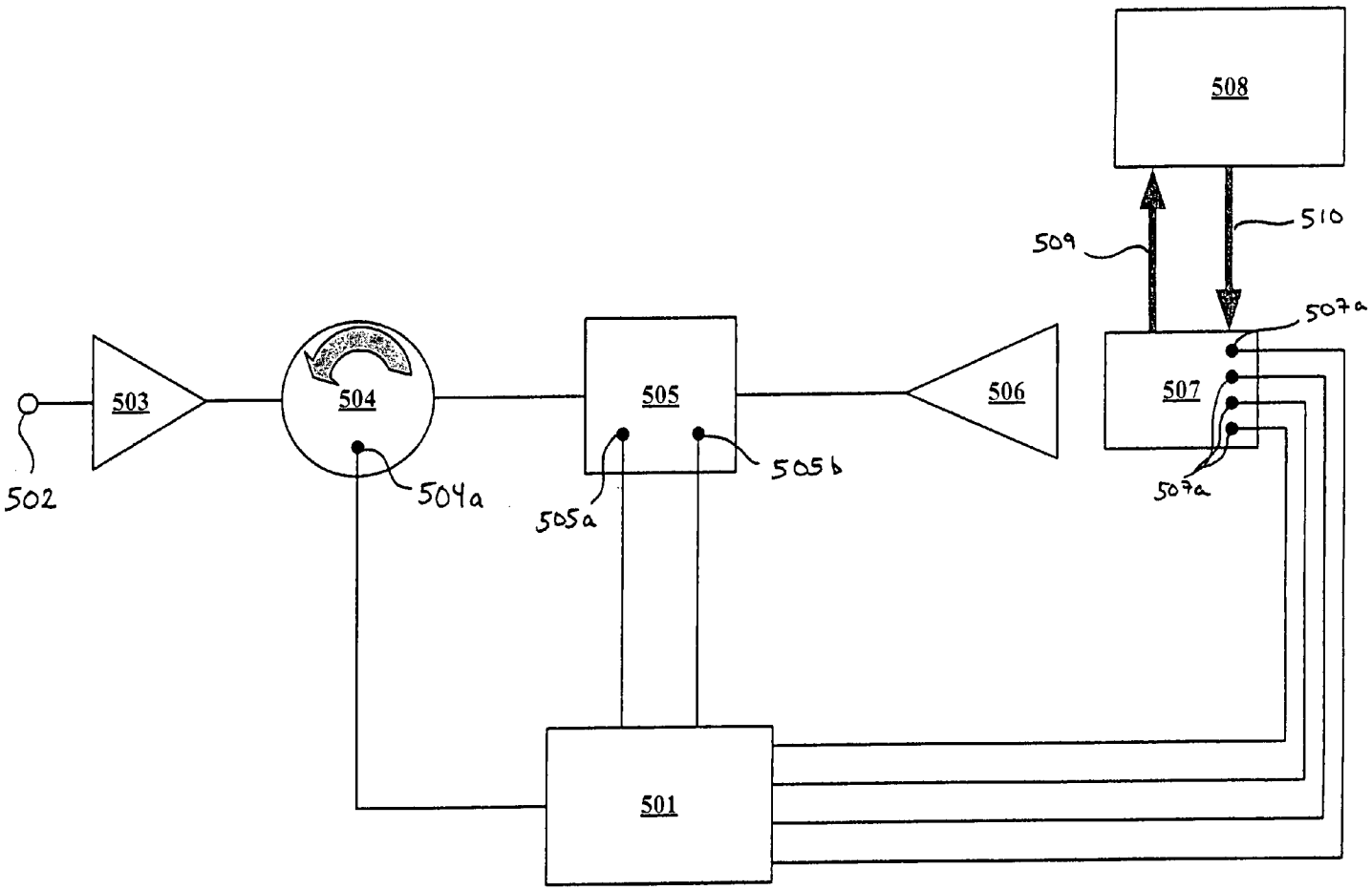
FIG. 5 is a block diagram depicting a pick-up horn arranged in a test configuration.

Turning to FIG. 5, a pick-up horn arranged in a test configuration according to one embodiment of the present invention is depicted. An input signal 502 is applied to an amplifier 503, which amplifies the signal and supplies it to horn antenna 506. Between amplifier 503 and horn antenna 506 is disposed a circulator load 504, which absorbs any power reflected back to amplifier 503 from horn antenna 506. A thermal monitor 504*a* is disposed on circulator load 504 and is connected to monitoring system 501. Also disposed between amplifier 503 and horn antenna 506 is a test coupler site 505, to which a coupled port 505*a* and an isolated port 505*b* are connected. Coupled port 505*a* is sensitive to power being supplied from amplifier 503 to horn antenna 506, while isolated port 505*b* is sensitive to power reflected from horn antenna 506 back to amplifier 503. Both coupled port 505*a* and isolated port 505*b* are connected to monitoring system 501. Pick-up horn 507 is disposed in front of horn antenna 506 to absorb the radiation emitted by horn antenna 506, as is described in greater detail above. Pick up horn includes a number of thermocouples 507*a*, which are connected to monitoring system 501 to monitor the temperature of pick-up horn 507.

Pick-up horn 507 is also connected by input line 510 and output line 509 to cooling system 508, which circulates coolant through pick-up horn 507 to remove the heat generated thereby. Cooling system 508 is programmed to maintain the coolant at a predetermined temperature. For example, according to one embodiment of the present invention, cooling system 508 is programmed to maintain a liquid $N_2$ coolant at −100° C.

Monitoring system 501 is programmed to monitor the temperature of pick-up horn 507 and circulator load 504, as well as the power supplied to horn antenna 506 and reflected therefrom to amplifier 503, to ensure that all values remain within predetermined safety parameters. In the event that one or more of these values exceeds a predetermined safety parameter, monitoring system 501 is programmed to provide an audible alarm, and/or to discontinue the test (e.g., by cutting off input signal 502).

Figure 6:
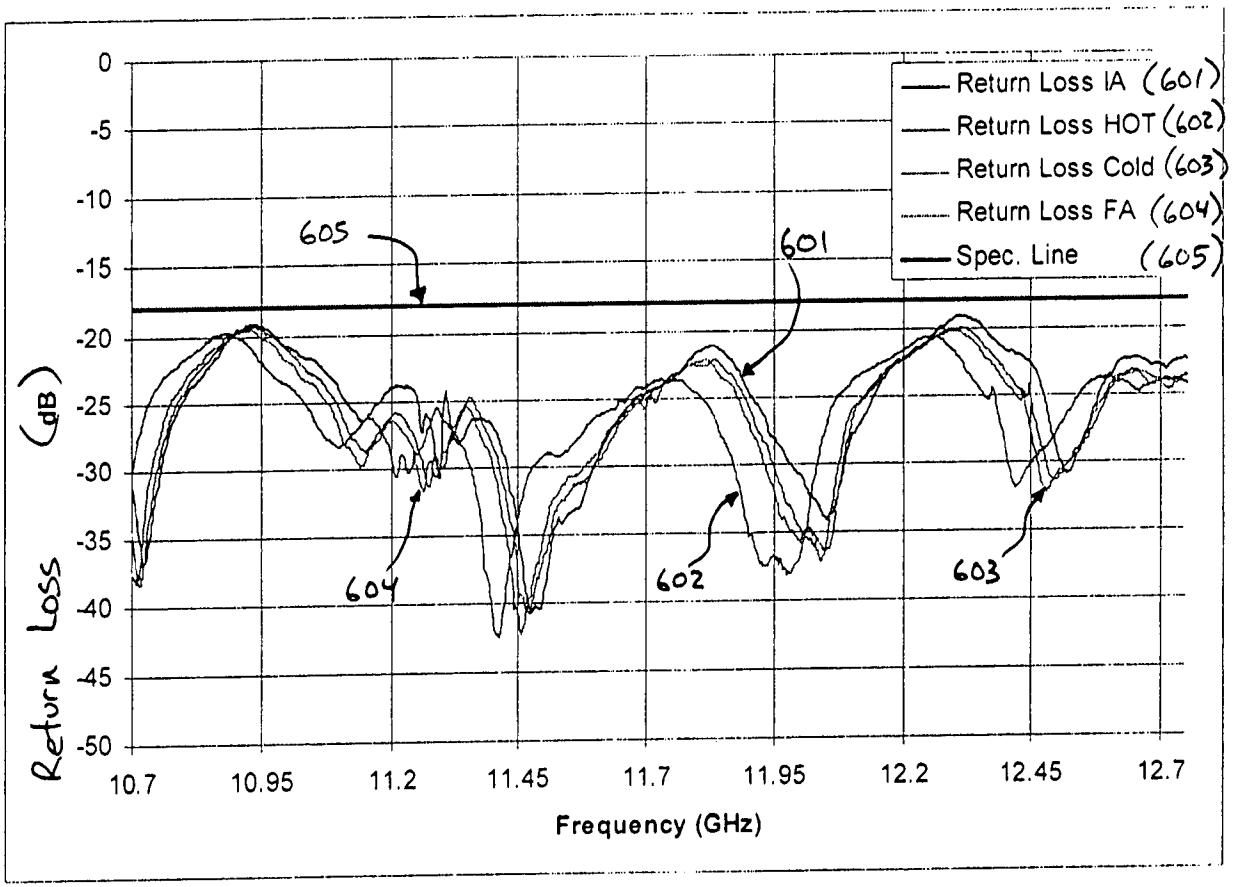
FIG. 6 is a graph illustrating the low return loss experienced by a flight horn when tested by a pick-up horn according to one embodiment of the present invention.

Turning to FIG. 6, the return loss (in dB) experienced by a flight horn when tested by a pick-up horn according to one embodiment of the present invention is charted at various frequencies during thermal cycling. For each of an initial ambient temperature test 601, a high temperature (i.e., 200° C.) test 602, a low temperature (i.e., −70° C.) test 603, and a final ambient temperature test 604, the return loss experienced by the pick-up horn when absorbing 2300 W of power in a vacuum is less than the specified −18 dB (e.g., spec line 605).

Figure 7:
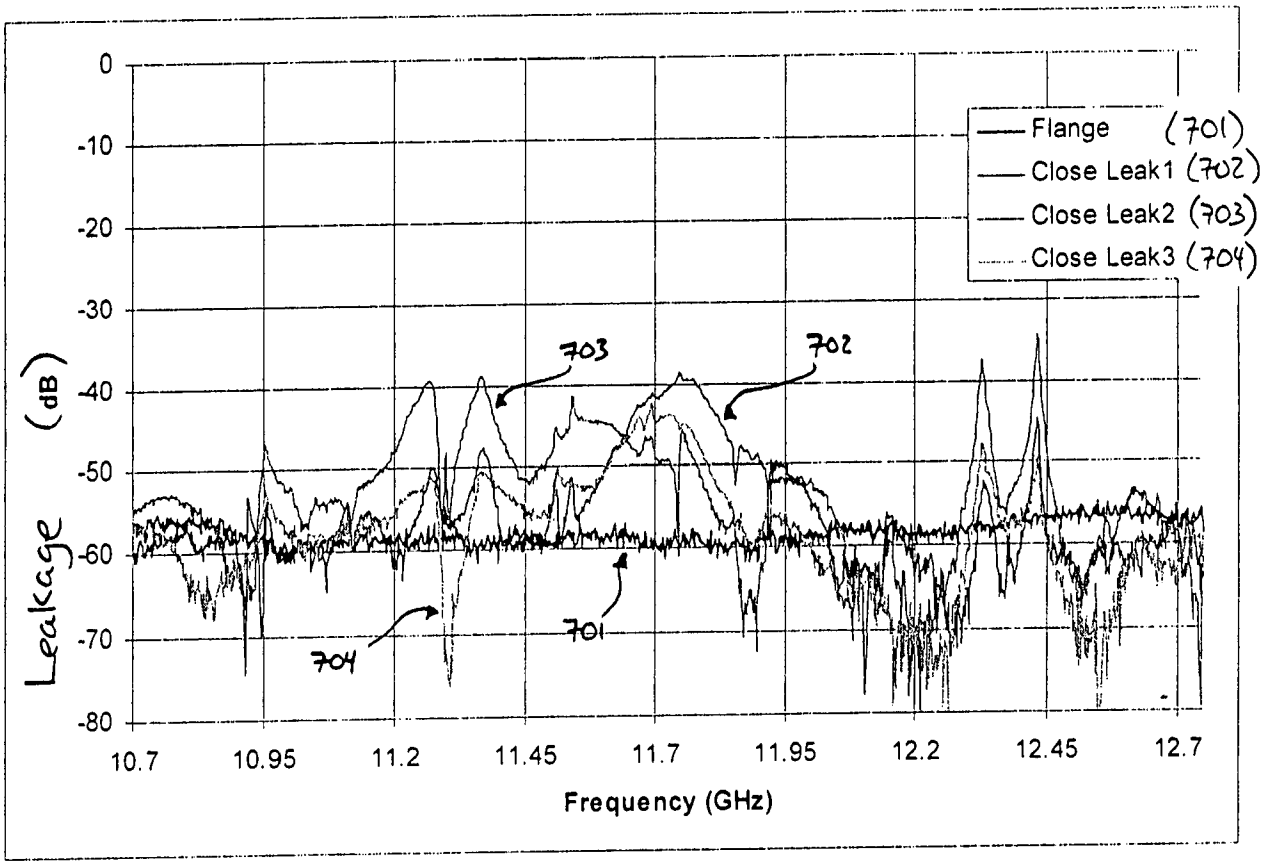
FIG. 7 is a graph illustrating the low leakage experienced by a flight horn when tested by a pick-up horn according to one embodiment of the present invention.

Turning to FIG. 7, the leakage (in dB) experienced by a flight horn radiating 2300 W in a vacuum when tested by a pick-up horn according to one embodiment of the present invention is charted at various frequencies and at various positions with respect to the pick-up horn. The leak measurements were taken with a directive WR75 open-ended waveguide as a probe without about 8.0 dBi directive gain. Flange measurement 701 was taken at the interface between the probe and the antenna under test. The "Close Leak 1" measurement 702 was taken at the junction of the pick-up horn and the probe when the probe was oriented at 0° (i.e., in line with the E-Field). The "Close Leak 2" measurement 703 was taken at the junction of the pick-up horn and the probe when the probe was oriented at 45°. The "Close Leak 3" measurement 704 was taken at the junction of the pick-up horn and the probe when the probe was oriented at 90°. As can be seen with reference to FIG. 7, the leakage experienced by the pick-up horn is below −50 dB (i.e., less than 0.01% of total input power) over a broad range of wavelengths (the measured leakage is about 8 dB lower than the values shown in FIG. 7, as a result of the 8 dBi directive gain of the probe).

While the present exemplary embodiments have been described with reference to high power thermal vacuum testing, the scope of the present invention is not limited to this arrangement. Rather, a pick-up horn of the present invention may be used for open-door testing (e.g., at ambient pressures), for low-power testing, or for any other arrangement in which a transmit antenna is tested.

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope of the invention.

What is claimed is:

1. A pick-up horn for absorbing radiation emitted by an antenna, the pick-up horn comprising:

at least one outer metal wall forming a metal body;

at least one interior surface disposed in the metal body and forming at least one chamber in the metal body;

a front metal surface disposed at a front end of the metal body, and having at least one opening corresponding to the at least one chamber;

at least one high-power absorbing load disposed within the at least one chamber and in contact with the at least one interior surface an RF shorting plate disposed at a back end of the metal body; and a coolant path disposed within the metal body, the coolant path including a coolant inlet and a coolant outlet, each of which is disposed on an outer surface of the at least one outer metal wall.

2. The pick-up horn of claim 1, wherein the coolant path is a serpentine coolant path disposed between an outer surface of the at least one outer metal wall and the at least one high-power absorbing load.

3. The pick-up horn of claim 1, further comprising at least one thermocouple disposed between the at least one high-power absorbing load and the at least one interior surface.

4. The pick-up horn of claim 3, wherein the at least one thermocouple is disposed in a groove in the at least one high-power absorbing load, the groove being located adjacent to the at least one interior surface.

5. The pick-up horn of claim 1, further comprising a radio frequency-transparent debris shield disposed over the front metal surface.

6. The pick-up horn of claim 1, further comprising an RF choke in the form of an annular groove disposed in an outer region of the front metal surface.

7. The pick-up horn of claim 1, further comprising at least one vent hole for providing an outgassing path between an outer surface of the at least one outer metal wall and the at least one interior surface.

8. The pick-up horn of claim 1, wherein the at least one chamber is a plurality of chambers, and wherein the front metal surface has an opening corresponding to each chamber, and the openings disposed nearer to a center of the front metal surface are larger than the openings disposed farther from the center.

9. The pick-up horn of claim 1, wherein the at least one opening is sufficiently large to accommodate any polarization of the radiation emitted by the antenna.

10. The pick-up horn of claim 1, wherein the at least one opening is sufficiently large to accommodate a plurality of higher order modes of the radiation emitted by the antenna.

11. The pick-up horn of claim 1, wherein the at least one opening is rectangular in shape.

12. The pick-up horn of claim 1, wherein the at least one high-power absorbing load is substantially wedge-shaped.

13. The pick-up horn of claim 1, wherein the at least one opening is elliptical in shape.

14. The pick-up horn of claim 1, wherein the at least one high-power absorbing load has a substantially conical shape.

15. The pick-up horn of claim 1, wherein the at least one high-power absorbing load is bonded to the at least one interior surface by a layer of thermally conductive bonding epoxy.

16. The pick-up horn of claim 1, wherein the at least one high-power absorbing load is a ceramic high-power absorbing load.

17. The pick-up horn of claim 1, wherein the pick-up horn is substantially RF-transparent to the antenna while absorbing the radiation emitted by the antenna.

18. The pick-up horn of claim 17, further comprising an RF choke in the form of an annular groove disposed in an outer region of the front metal surface.

19. A pick-up horn for absorbing radiation emitted by an antenna, the pick-up horn comprising:

at least one outer metal wall forming a metal body;

a plurality of interior surfaces disposed in the metal body and forming a plurality of chambers in the metal body;

a front metal surface disposed at a front end of the metal body, and having a plurality of openings corresponding to the plurality of chambers;

a plurality of ceramic high-power absorbing loads, each high-power absorbing load disposed within a corresponding one of the plurality of chambers and in contact with at least one of the plurality of interior surfaces; and a serpentine coolant path disposed within the metal body between an outer surface of the at least one outer metal wall and the plurality of ceramic high-power absorbing loads, the coolant path including a coolant inlet and a coolant outlet, each of which is disposed on the outer surface of the at least one outer metal wall.

* * * * *